US011224114B2

(12) United States Patent
Shin

(10) Patent No.: US 11,224,114 B2
(45) Date of Patent: Jan. 11, 2022

(54) X-RAY GENERATOR

(71) Applicants: VATECH Co., Ltd., Gyeonggi-do (KR); VATECH EWOO Holdings Co., Ltd., Gyeonggi-do (KR)

(72) Inventor: Seung Hun Shin, Gyeonggi-do (KR)

(73) Assignees: VATECH Co., Ltd., Gyeonggi-do (KR); VATECH EWOO Holdings Co., Ltd., Gyeonggi-do (KR)

( * ) Notice: Subject to any disclaimer, the term of this patent is extended or adjusted under 35 U.S.C. 154(b) by 0 days.

(21) Appl. No.: 17/130,583

(22) Filed: Dec. 22, 2020

(65) Prior Publication Data

US 2021/0204386 A1 Jul. 1, 2021

(30) Foreign Application Priority Data

Dec. 27, 2019 (KR) ..... 10-2019-0176499
Oct. 30, 2020 (KR) ..... 10-2020-0143124

(51) Int. Cl.
*H05G 1/02* (2006.01)
*H05G 1/12* (2006.01)
(Continued)

(52) U.S. Cl.
CPC ..... *H05G 1/025* (2013.01); *H05G 1/12* (2013.01); *H05G 1/32* (2013.01); *H05G 1/265* (2013.01); *H05G 1/46* (2013.01); *H05G 1/54* (2013.01)

(58) Field of Classification Search
CPC ..... H05G 1/46; H05G 1/025; H05G 1/12; H05G 1/265; H05G 1/32; H05G 1/54; H05G 1/36; H05G 1/24
See application file for complete search history.

(56) References Cited

U.S. PATENT DOCUMENTS 5,077,771 A 12/1991 Skillicorn et al.
6,208,706 B1 3/2001 Campbell et al.
(Continued)

FOREIGN PATENT DOCUMENTS

DE 1199412 B 8/1965
DE 20218138 U1 4/2004
(Continued)

OTHER PUBLICATIONS

European Patent Office, European Search Report of corresponding EP Patent Application No. 20214788.0, dated May 11, 2021.

*Primary Examiner* — Chih-Cheng Kao
(74) *Attorney, Agent, or Firm* — IP Legal Services, LLC

(57) ABSTRACT

The X-ray generator includes a booster for boosting a first DC voltage supplied from a voltage source to a second DC voltage higher than the first DC voltage, at least one capacitor for receiving the second DC voltage and generating a charging voltage on the basis of the second DC voltage, a converter for converting the charging voltage into a driving voltage, an X-ray source for receiving the driving voltage and emitting X-rays according to the driving voltage, and a controller for controlling the booster, the converter, and the X-ray source. The controller calculates a cooling time required for cooling the X-ray source to a predetermined temperature or lower, determines the magnitude of the second DC voltage according to the cooling time, and applies the second DC voltage to the capacitor for the cooling time.

6 Claims, 7 Drawing Sheets

(51) Int. Cl.

| | |
|---|---|
| ***H05G 1/32*** | (2006.01) |
| *H05G 1/26* | (2006.01) |
| *H05G 1/46* | (2006.01) |
| *H05G 1/54* | (2006.01) |

(56) References Cited

U.S. PATENT DOCUMENTS

| | | | | |
|---|---|---|---|---|
| 6,556,462 | B1 * | 4/2003 | Steigerwald ..... | H02M 5/458<br>363/89 |
| 2006/0013363 | A1 | 1/2006 | Heuft et al. | |

FOREIGN PATENT DOCUMENTS

| | | | | |
|---|---|---|---|---|
| EP | 0998173 | A1 | | 5/2000 |
| JP | 2013254573 | A | * | 12/2013 |

* cited by examiner

X-RAY GENERATOR

CROSS REFERENCE TO RELATED APPLICATION

The present application claims priority to Korean Patent Application Nos. 10-2019-0176499 and 10-2020-0143124, respectively field on Dec. 27, 2019 and Oct. 30, 2020, the entire contents of which are incorporated herein for all purposes by this reference.

BACKGROUND OF THE INVENTION

Field of the Invention

The present invention relates to an X-ray generator.

Description of the Related Art

In recent years, with the development of semiconductors and information processing technology, X-ray radiography is rapidly being replaced with digital radiography (DR) that uses digital sensors. However, X-ray radiography technology is also being continuously researched and developed for specific applications.

An example is intra-oral X-ray radiography which is mainly used in dental clinics.

Intra-oral X-ray radiography is an X-ray imaging technology for obtaining an X-ray image of a limited area in a subject's oral cavity. An X-ray sensor is placed in the subject's oral cavity, X-rays are emitted from an X-ray generator disposed outside the oral cavity, and an X-ray image of a tooth and the surrounding tissue is acquired. These intra-oral X-ray images have the advantage of low distortion, high resolution and sharpness, and relatively low radiation exposure. Therefore, X-ray images are mainly used for implant procedures or root canal treatments that require a high resolution image.

X-ray radiographic devices for intra-oral X-ray radiography are referred to as portable X-ray generators, and in most cases, X-ray images are usually taken with an X-ray radiographic device held in an operator's hand. To increase the convenience and accuracy of intra-oral X-ray radiography and to improve the utilization of X-ray generators, it is required to reduce the weight and size of the X-ray generators for intra-oral X-ray radiography.

SUMMARY OF THE INVENTION

An objective of the present invention is to provide an X-ray generator with a light and compact body and an increased efficiency resulting from a reduced waiting time for X-ray generation.

In order to accomplish the objective of the present invention, there is provided an X-ray generator including: a booster configured to boost a first DC voltage supplied from a voltage source to a second DC voltage higher than the first DC voltage; at least one capacitor configured to receive the second DC voltage and generate a charging voltage from the second DC voltage; a converter configured to convert the charging voltage into a driving voltage; an X-ray source configured to receive the driving voltage and emit X-rays; and a controller configured to control the booster, the converter, and the X-ray source. The magnitude of the second DC voltage is variable. The controller calculates a cooling time required for cooling the X-ray source to a predetermined temperature or lower, determines the magnitude of the second DC voltage according to the cooling time, and applies the second DC voltage to the capacitor during a cooling operation performed for the cooling time.

The booster may include: an input terminal including an inductor connected to the voltage source; an output terminal including a diode connected to the capacitor; and a switching element that turns on and off such that the input terminal and the output terminal are connected to each other or disconnected from each other. The controller may control an ON and OFF cycle of the switching element to control the magnitude of the second DC voltage.

The booster may include an input capacitor connected in parallel between the voltage source and the inductor and an output capacitor connected in parallel between the diode and the capacitor.

The controller may stop the driving voltage from being applied to the X-ray source during the cooling operation performed for the cooling time.

The X-ray generator may further include a user input unit that receives X-ray imaging information including X-ray imaging mode and imaging conditions from a user, and the controller may calculate the cooling time on the basis of the X-ray imaging information.

The X-ray generator may further include a temperature sensor that measures a temperature of the X-ray source, and the controller may calculate the cooling time on the basis of the temperature of the X-ray source.

The present invention has the effect of providing a highly efficient X-ray generator having a light and compact body for convenience of use and being capable of increasing imaging efficiency by minimizing a waiting time for X-ray generation.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
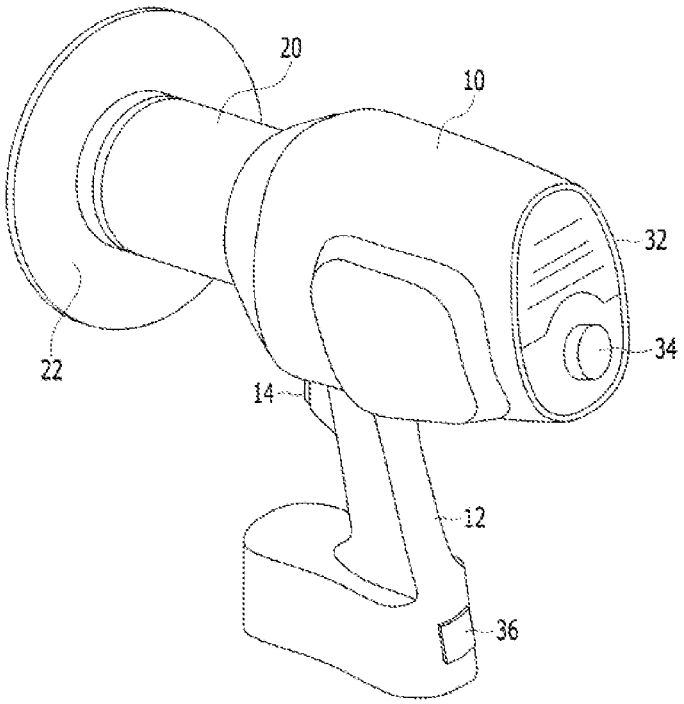
FIG. 1 is a perspective view illustrating the overall construction of an X-ray generator according to one embodiment of the present invention.

The above-described objectives, features, and advantages will be more clearly understood with reference to the accompanying drawings and embodiments described below.

In the following description, the specific structural or functional descriptions for exemplary embodiments according to the concept of the present invention are merely for illustrative purposes. The embodiments according to the concept of the present invention may be implemented in various forms and should not be construed as being limited to the embodiments described in the specification of the present application.

Embodiments in accordance with the concept of the present invention can undergo various changes to have various forms, and only some specific embodiments are illustrated in the drawings and described in detail in the present disclosure. While specific embodiments of the present invention are described herein below, they are only for illustrative purposes and should not be construed as limiting to the present invention. Thus, the present invention should be construed to cover not only the specific embodiments but also cover all modifications, equivalents, and substitutions that fall within the concept and technical spirit of the present invention.

It is to be understood that when any element is referred to as being "connected to" or "coupled to" another element, it may be connected directly to or be coupled directly to another element or be connected to or coupled to another element indirectly, having a further element intervening therebetween. In contrast, it should be understood that when an element is referred to as being "directly coupled" or "directly connected" to another element, there are no intervening elements present between them. Other expressions for describing the relationship between the constituent elements, such as "between" and "directly between" or "adjacent to" and "directly adjacent to" should be interpreted in the same manner.

The terminology used herein is for the purpose of describing particular embodiments only and is not intended to limit the scope of the present invention. As used herein, the singular forms "a", "an", and "the" are intended to include the plural forms as well unless the context clearly indicates otherwise. It will be further understood that the terms "comprises", "includes", or "has" when used in the present disclosure specify the presence of stated features, regions, integers, steps, operations, elements and/or components, but do not preclude the presence or addition of one or more other features, regions, integers, steps, operations, elements, components and/or combinations thereof.

In addition, unless otherwise defined, all terms including technical and scientific terms used herein have the same meaning as commonly understood by those who are ordinarily skilled in the art to which this invention pertains. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Hereinafter, modes of the present invention will be described in detail with reference to the accompanying drawings. Through the drawings, like reference symbols denote like elements.

FIG. 1 is a perspective view illustrating the overall construction of an X-ray generator according to one embodiment of the present invention.

As illustrated, an X-ray generator according to one embodiment of the present invention includes: a main body 10 in which a power supply unit, a controller, a converter, an X-ray source, etc., which will be described later, are mounted; a handle 12 provided on one side of the main body 10 to allow a user to hold the X-ray generator for use; an emission switch 14 provided on one side of the main body 10, preferably near the handle 12, for user manipulation to emit X-rays; an emission port 20 provided on one side of the body 10 and configured to emit X-rays; a shielding plate 22 provided along the periphery of the emission port 20 to minimize exposure of a user of the X-ray generator to the X-rays emitted from the X-ray generator; an instrument panel 32 provided on one side of the main body 10 and configured to display operation-related messages and various types of X-ray imaging information including an imaging mode and imaging conditions; a user input unit 32 such as a button or a dial for user manipulation; and a power connector 36 provided on one side of the handle 12, connected to an external power source to receive external power as a voltage source or as a battery charging power source.

Therefore, the user holds the handle 12 and lifts the main body 10 to set an appropriate imaging mode and imaging conditions using the instrument panel 32 and the user input unit 34, aims the emission port 20 of the main body 10 at an X-ray application target position, and manipulates the emission switch 14 to emit X-rays to the X-ray application target position through the emission port 20. The shielding plate 22 blocks X-rays scattering backward to minimize the exposure of the user to X-rays. The power connector 36 is connected to an external power source through an adapter, etc. to receive external power as a voltage source or a battery charging power source.

FIG. 1 is only an example of an X-ray generator according to the present invention, and the shape or structure of the X-ray generator may vary.

Figure 2:
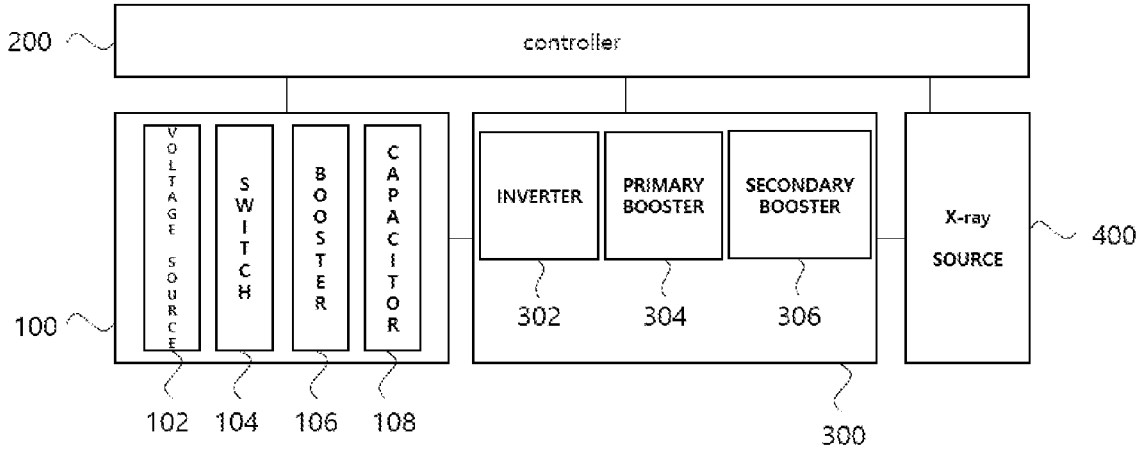
FIG. 2 is a diagram illustrating the construction of an X-ray generator according to one embodiment of the present invention.

FIG. 2 is a diagram illustrating the internal construction of the X-ray generator according to the present invention and shows only parts necessary for description of the present invention.

As illustrated, the X-ray generator according to the present invention includes a power supply unit 100, a controller 200, a power converter 300, and an X-ray source 400.

The power supply unit 100 includes a voltage source 102, a switch 104, a booster 106, and a capacitor 108.

The voltage source 102 may be a battery. Specifically, it may be a commercial primary battery or a commercial secondary battery. The battery may be one battery or two or more batteries. When the battery is a primary battery and it is exhausted, the primary battery will be replaced with a new battery. When the battery is a secondary battery and it is exhausted, the battery will be charged to be used as a voltage source again. Under the premise that the battery is a commercial primary battery, the only configuration that needs to be replaced or changed in the X-ray generator according to the present invention is the battery. As will be described later, the requirement for the voltage source in the X-ray generator according to the present invention is a voltage source that can provide a low voltage (for example, 2.5V to 4.2V). The present invention uses a commercial primary battery or a commercial secondary battery as a voltage source, thereby minimizing the size of the X-ray generator and minimizing the charging time of the battery.

For reference, the voltage source 102 of the X-ray generator according to the present invention may be an external power source instead of a battery. When the voltage source 102 is a secondary battery, the secondary battery may be charged with an external power source.

The switch 104 controls electrical connection and disconnection between the voltage source 102 and the capacitor 106, thereby blocking or allowing a first DC voltage supplied from the voltage source 102 to the booster 106.

The switch 104 turns on and off according to an ON/OFF control signal received from the controller 200.

The switch 104 receives an ON control signal from the controller 200 and electrically connects the voltage source 102 and the booster 106 to each other. When the voltage source 102 and the booster 106 are connected via the switch 104, the first DC voltage output from the voltage source 102 is boosted to a second DC voltage by the booster 106, and the capacitor 108 is charged with the secondary DC voltage. When the switch 104 receives an OFF control signal from the controller 200, it electrically disconnects the voltage source 102 and the booster 106 from each other. When the switch 41 turns off so that the voltage source 102 and the booster 103 are disconnected from each other, the voltage supply from the voltage source 102 is cut off, and the charging of the capacitor 104 is stopped.

Although the description in the present disclosure and the illustration in the illustration show that the switch 104 is interposed between the voltage source 102 and the booster 106, it is possible that the switch 102 is positioned between the booster 106 and the capacitor 108.

The booster 106 is connected to the voltage source 102 via the switch 104, and the driving of the booster 106 is controlled according to the ON/OFF state of the switch 104. The booster 106 converts the first DC voltage output from the voltage source 102 into the second DC voltage used to charge the capacitor 108. For example, the booster 106 receives a low voltage within a range of from 2.5 V to 4.2 V from the voltage source 102 as the first DC voltage, boosts the first DC voltage to a high voltage in a range of from 24 V to 30 V (0.15 A) as the second DC voltage suitable for charging the capacitor 108. To this end, the booster 106 includes a DC/DC booster converter circuit.

Figure 3:
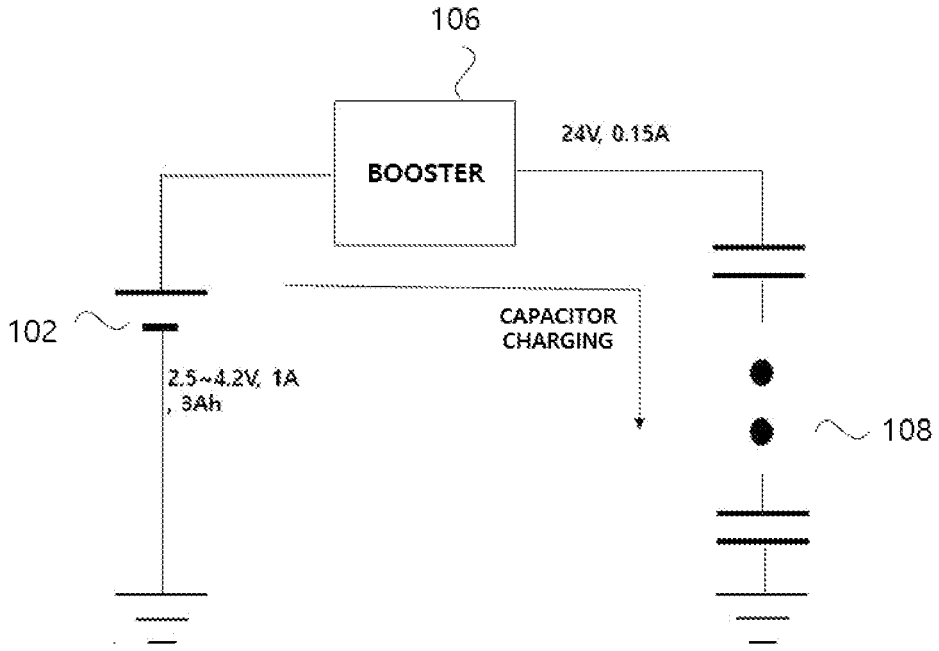
FIG. 3 is a circuitry diagram illustrating a power supply unit of the X-ray generator according to one embodiment of the present invention.

FIG. 3 is a circuitry diagram illustrating the power supply unit of the X-ray generator according to the present invention in a case where the power supply unit 100 includes a voltage source 102 and a capacitor 108 composed of a plurality of series-connected capacitor elements. The booster 106 receives the first DC voltage (in a range of 2.5 V to 4.2 V) which is an output voltage of the voltage source 102 and converts the first DC voltage into the second DC voltage (in a range of 24 V to 30 V) which is a voltage suitable for charging the capacitor 108.

Figure 4:
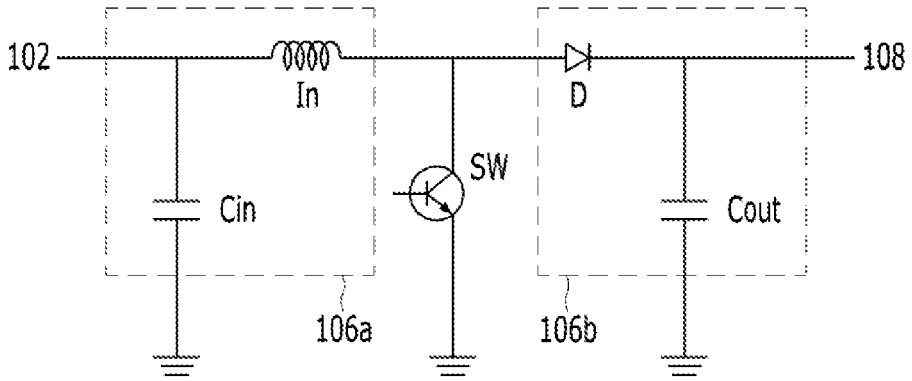
FIG. 4 is a circuitry diagram illustrating a booster of the X-ray generator according to one embodiment of the present invention.

FIG. 4 is a circuitry diagram illustrating the booster 106 of the X-ray generator according to the present invention. The booster 106 includes an input terminal 106*a* including an inductor In connected in series with the voltage source 102, an output terminal 106*b* including a diode D connected in series with the capacitor 108, and a switching element SW for controlling the electrical connection and disconnection between the input terminal 106*a* and the output terminal 106*b*. An input capacitor Cin is connected in parallel between the voltage source 102 and the inductor In, and an output capacitor Cout is connected in parallel between the diode D and the capacitor 108.

When the switching element SW is turned on, the inductor In is supplied with current. Conversely, when the switching element SW is turned off, the current is discharged from the inductor In, and the second DC voltage higher than the first DC voltage is transmitted to the capacitor 108. The magnitude of the second DC voltage varies depending on the ON and OFF cycle of the switching element SW, and the controller 200 to be described later controls the ON and OFF cycle of the switching element SW to adjust the magnitude of the second DC voltage.

Referring to FIG. 2, the capacitor 108 is charged with the secondary DC voltage supplied from the booster 106. The capacitor 108 supplies a charging voltage to the converter 300 for X-ray emission. The capacitor 108 is composed of at least two capacitor elements connected in series. For example, assuming that electric power of 65 kV, 3 mA, and 1 second is required to drive the X-ray source 400, the capacitor 108 is composed of 2 to 4 capacitor elements having a capacitance of 25F to 30F. Assuming that the capacitor element is an electrolytic capacitor having a size of about 12.5 ø×20 mm, the size of the capacitor 108 may be about 25×50×20 mm.

In the case of a comparative example in which only the first DC voltage output from the battery is used, since it is necessary to instantaneously apply a high voltage to the X-ray source 400, the lifespan and durability of the battery are reduced. In the case of another comparative example in which only the DC voltage of a specially designed high-power battery is used, there is a problem in that the cost of the X-ray generator increases. In the case of a further comparative example in which only the DC voltage of a high-capacity capacitor is used, since the energy density of the capacitor is low, the size of the power supply unit is increased. Therefore, it is inconvenient to use the X-ray generator. In the case of a further comparative example in which only the DC voltage of a low-capacitance capacitor is used, there is a problem in that it is inconvenient to use the X-ray generator due to the hassle of charging the battery of the X-ray generator each time a radiographic operation is performed.

However, in the present invention, the power supply unit 100 is composed of the voltage source 102 implemented with a high energy-density battery and the capacitor 104 implemented with multiple capacitor elements connected in series to output a high voltage. Since the size of the power supply unit is reduced, the X-ray generator is accordingly light and compact, and thus the imaging efficiency and convenience of the X-ray generator are increased.

The controller 200 controls the overall operation of the X-ray generator apparatus according to the present invention.

Referring to FIG. 1, the controller 200 controls the converter 300 to adjust the magnitude of the voltage supplied to the X-ray source 400 when the user inputs X-ray imaging information such as an imaging mode and imaging conditions through the instrument panel 32 and the user input unit 34. When the user inputs an X-ray emission command through the emission switch 14, the controller 200 controls the converter 300 to supply the driving voltage to the X-ray source 400 so that X-rays are emitted. When X-ray imaging is completed, the controller 200 controls the converter 300 not to supply the driving voltage to the X-ray source 400, thereby stopping the X-ray emission. However, during a cooling operation performed for a cooling time which is a predetermined period of time after the X-ray emission is performed, even though the user inputs an X-ray irradiation command through the emission switch 14, the controller 200 controls the converter 300 not to supply the driving voltage to the X-ray source 400 so that the X-ray source 400 can be cooled to a preset temperature or below.

In particular, the controller 200 of the X-ray generator according to the present invention calculates the cooling time on the basis of the temperature of the X-ray source 400 or on the X-ray imaging information after the X-ray imaging information is input through the user input unit 34 or after the X-ray emission is performed by the X-ray source 400. In addition, the controller controls the driving time of the booster 106 and the magnitude of the second DC voltage such that the charging voltage of the capacitor 108 becomes equal to or higher than a predetermined voltage within the calculated cooling time. In addition, the controller 200 displays an X-ray emission ready message notifying that it is ready for X-ray imaging, on the instrument panel 32 when the temperature of the X-ray source 400 is lowered to the predetermined temperature or below after the charging of the capacitor 108 is completed.

In addition, the controller 200 of the X-ray generator according to the present invention monitors the status of the power supply unit 102 and the X-ray source 400 and provides an appropriate notification message to the user through the instrument panel 32 on the basis of the monitoring result. For example, the controller 200 measures the residual voltage of the battery and displays a battery replacement request message on the instrument panel 32 to request the replacement of the battery when the residual voltage of the battery is equal to or less than a preset level. In addition, the controller 200 checks whether the capacitor 108 is overcharged or short-circuited and displays a capacitor abnormality notification message on the instrument panel 32 when overcharging or short-circuit is detected. In addition, the controller measures the real-time temperature of the X-ray source 400 and displays the real-time temperature on the instrument panel 32.

Figure 5:
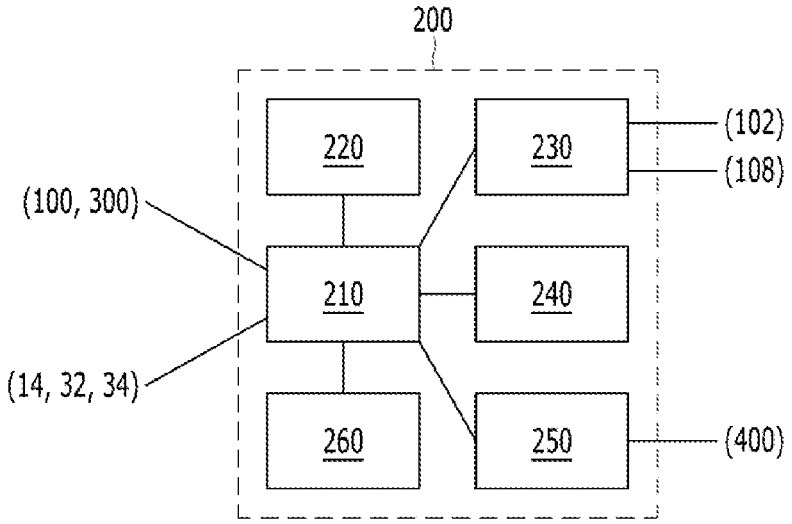
FIG. 5 is a block diagram illustrating a controller of the X-ray generator according to one embodiment of the present invention.

FIG. 5 is a diagram illustrating the construction of the controller of the X-ray generator according to one embodiment of the present invention.

As illustrated in FIG. 5, the controller 200 includes a logic operation circuit 210 equipped with a series of control algorithms for X-ray radiography, a memory 240 for storing X-ray imaging information used to calculate a cooling time or for storing cooling time information for each temperature of the X-ray source 400, a power supply unit 100, a power supply management module 230 for monitoring the voltage source 102 and the capacitor 108, a temperature sensor 250 for measuring the temperature of the X-ray source 400, and a timer 260 for counting time for the cooling time.

The operations of the controller 200 will be described in detail below.

Referring to FIG. 2, the converter 300 boosts the charging voltage supplied from the capacitor 108 to a driving voltage (for example, 65 kV, 3 mA) for driving the X-ray source 400 and supplies the driving voltage to the X-ray source 400.

The converter 300 includes an inverter 302, a primary booster 304 and a secondary booster 306. For example, the primary booster 304 includes a transformer, and the secondary booster 304 includes a Cockcroft-Walton generator. The Cockcroft-Walton generator is composed of an n-fold voltage rectifier circuit or a Cockcroft multiplier and rectifier circuit.

The converter 300 is controlled by the ON/OFF control signal transmitted to the inverter 302 from the controller 200. When the ON control signal is transmitted to the inverter 302 from the controller 200, the converter 300 converts the charging voltage supplied from the capacitor 108 of the power supply unit 100 into a driving voltage and supplies the driving voltage to the X-ray source 400 so that the X-ray source 400 emits X-rays according to the driving voltage.

After X-rays are emitted in accordance with the X-ray imaging information, the controller 200 cuts off the driving voltage supplied to the X-ray source by transmitting the OFF control signal to the inverter 302 so that the X-ray emission of the X-ray source is stopped.

The X-ray source 400 receives the driving voltage from the converter 300, generates X-rays, and emits the X-rays to a subject. The X-ray source 400 is a field emission X-ray source including a cathode electrode having an emitter, an anode electrode having an X-ray target surface, and a gate electrode controlling the field emission of the emitter.

Figure 6:
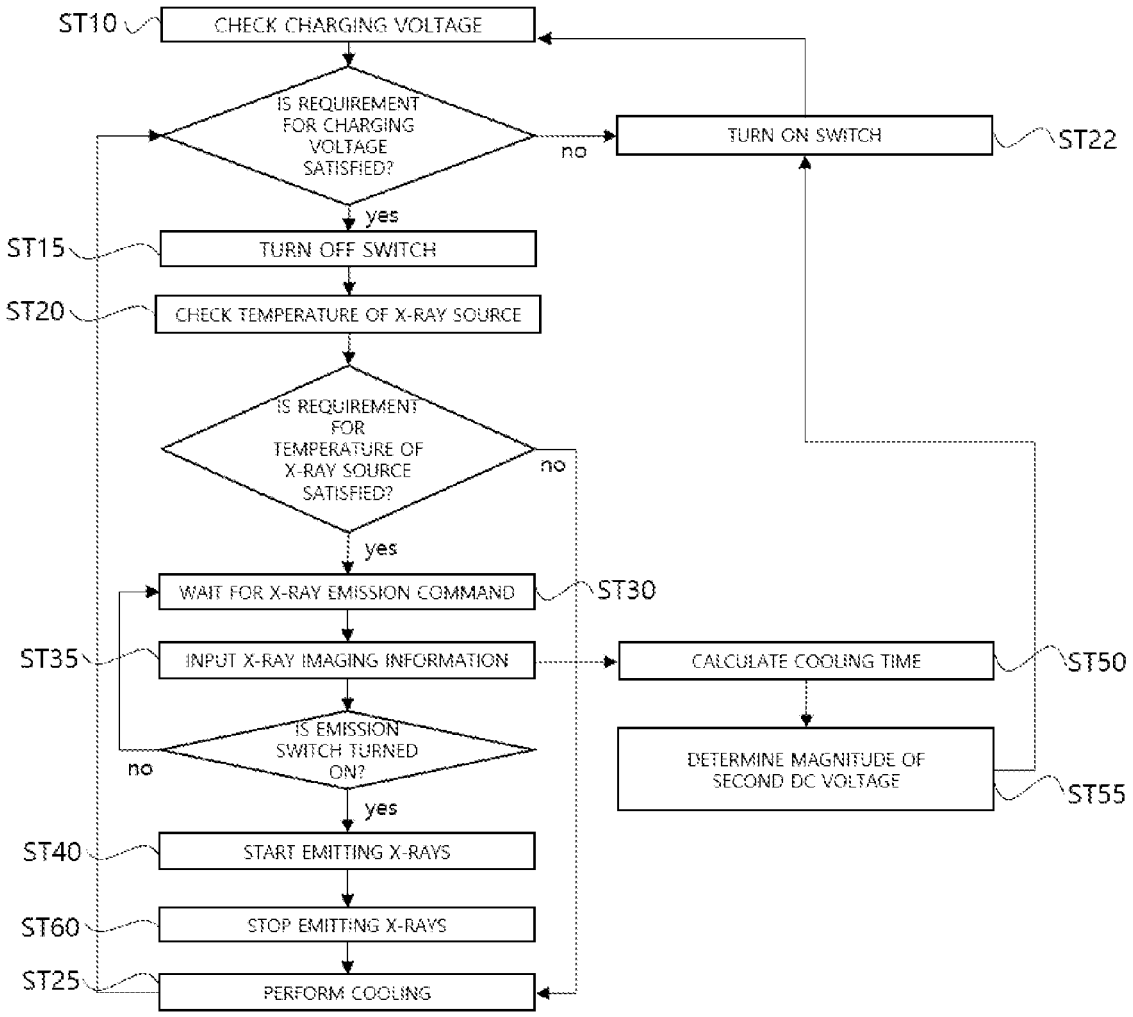
FIGS. 6 and 7 are flowcharts illustrating a method of driving the X-ray generator according to one embodiment of the present invention.
Figure 7:
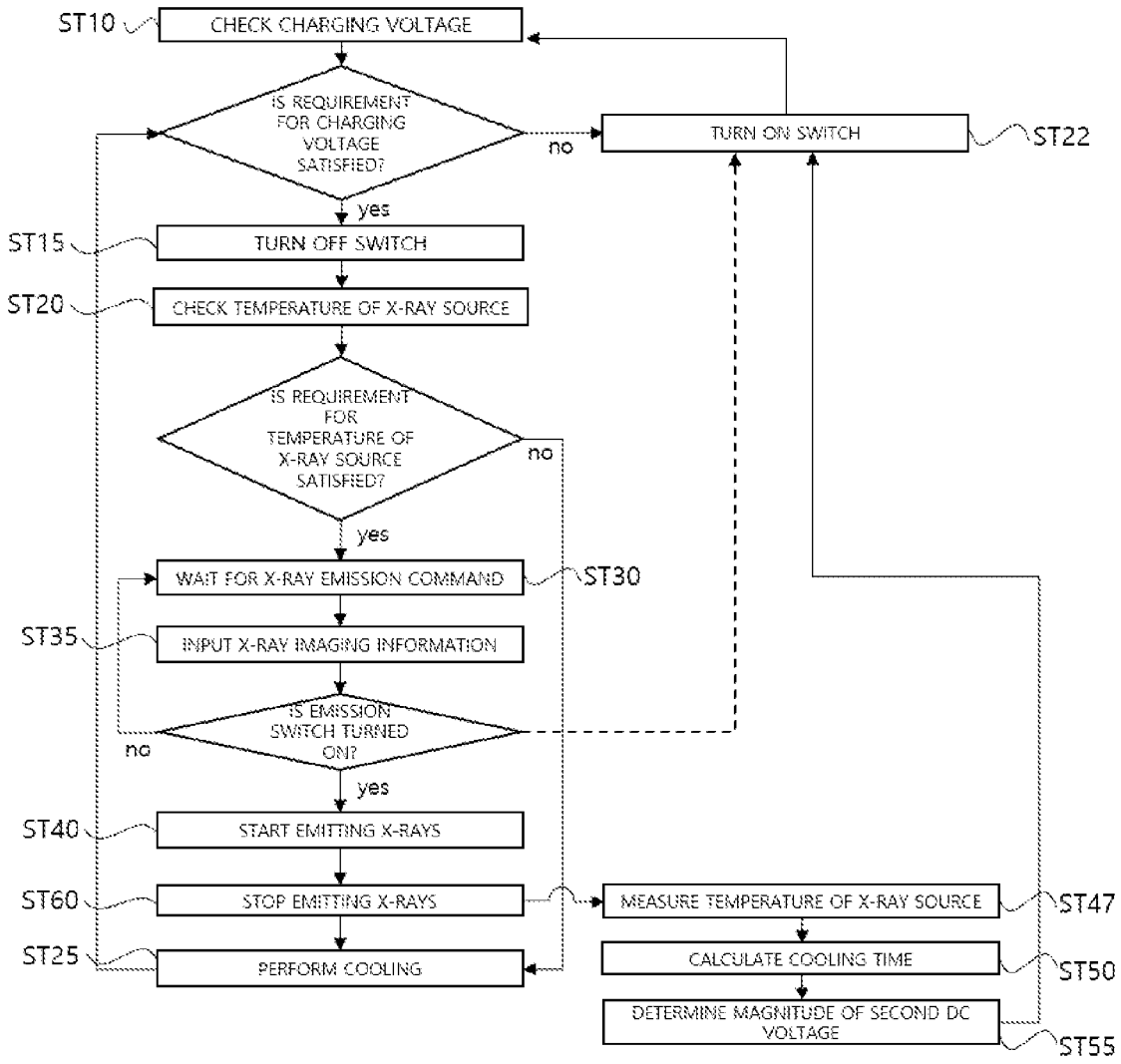

FIGS. 6 and 7 are flowcharts showing a method of driving an X-ray generator, according to the present invention. The driving method of the X-ray generator and specific operations of the controller will be described with reference to FIGS. 1 to 5 and FIGS. 6 and 7. The present disclosure provides two embodiments for the driving method of the X-ray generator according to the present invention. The operations that are common between a first embodiment and a second embodiment will be described in a section labeled "First Embodiment", and only a difference between the first embodiment and the second embodiment will be described in a section labeled "Second Embodiment" below.

First Embodiment

In order to drive the X-ray generator according to the present invention, the controller 200 controls the power management module 230 to check whether the charging voltage of capacitor 108 is equal to or greater than a predetermined voltage value (ST10).

When the charging voltage of the capacitor 108 is higher than or equal to the predetermined voltage value, the controller 200 turns off the switch 104 of the power supply unit 100 to block the second DC voltage so that the second DC voltage cannot be transmitted to the capacitor 108, thereby preventing overcharging of the capacitor 108 (ST15). Conversely, when the charging voltage of the capacitor 108 is lower than the predetermined voltage value, the controller 200 turns on the switch 104 of the power supply unit 100 so that the second DC voltage can be transmitted to the capacitor 108, thereby charging the capacitor 108 with the second DC voltage (ST22). The magnitude of the second DC voltage is preset.

The controller 200 checks the temperature of the X-ray source 400 with the use of the temperature sensor 250 (ST20). When the temperature of the X-ray source 400 is higher than a predetermined temperature, the controller 200 maintains the cooling operation by which the transmission of the driving voltage from the converter 300 to the X-ray source 400 is blocked even though the user inputs an X-ray emission command through the emission switch 14 (ST25). On the other hand, when the temperature of the X-ray source 400 is lower than the predetermined temperature, the controller 200 displays the X-ray emission ready message on the instrument panel 32 and waits for a user's X-ray emission command (ST30).

Subsequently, when the user inputs X-ray imaging information such as imaging mode and imaging conditions through the user input unit 34 and inputs an X-ray emission command by pushing the X-ray emission switch 14, the controller 200 adjusts the driving voltage of the converter 300 and transmits the adjusted driving voltage to the X-ray source 400 so that an X-ray imaging operation is performed according to the X-ray imaging information, and the X-ray source 400 emits X-rays (ST35, ST40). When an X-ray emission command is not input, the controller 200 waits for an X-ray emission command input through the X-ray emission switch 14 (ST30).

In addition, when the X-ray imaging information is input through the user input unit 34, the controller 200 calculates an estimated cooling time on the basis of the cooling time information stored in the memory 240. The cooling time information is configured in the form of a table in which each piece of the X-ray imaging information is associated with a specific cooling time (ST50).

For reference, the first embodiment differs from the second embodiment described below in that the charging time for the capacitor 108 is maximized and, to this end, the controller 200 calculates the estimated cooling time on the basis of the X-ray imaging information input through the user input unit 34. Therefore, the controller 200 calculates the estimated cooling time after the X-ray imaging information is input through the user input unit 34. That is, the calculation of the estimated cooling time is performed before the X-ray emission is performed by the X-ray source 400 or at the time when the X-ray emission of the X-ray source 400 is performed.

Next, the controller 200 determines the magnitude of the second DC voltage for completing the charging of the capacitor 108 within the calculated cooling time (ST55). The cooling time and the magnitude of the second DC voltage have an inverse linear correlation. Therefore, a predetermined function for calculating the magnitude of the second DC voltage according to the cooling time is stored in the memory 240, or second DC voltage information that is present in the form of a table in which second DC voltages and cooling times are respectively matched is stored in the memory 240.

Next, the controller 200 controls the booster 106 to boost the first DC voltage to the second DC voltage having a magnitude that is determined in step ST55. To this end, the controller 200 adjusts the ON and OFF cycle of the switching element SW of the booster 106. The ON time and the magnitude of the second DC voltage are in a proportional correlation.

On the other hand, when the X-ray emission in accordance with the desired X-ray imaging information is completed, the controller 200 blocks the driving voltage transmitted from the converter 300 to the X-ray source 400, thereby stopping the X-ray emission (ST60).

Next, the controller 200 maintains the cooling operation for the cooling time. During the cooling operation, even though the user inputs an X-ray emission command through the emission switch 14, the driving voltage output from the converter 300 is blocked not to be input to the X-ray source 400. In this case, the controller 200 displays a message notifying that the cooling operation is performed on the instrument panel 32. Preferably, the remaining cooling time may be displayed together with the message on the instrument panel 32 (ST25).

Next, when the cooling time is over, the controller 200 performs step ST10 and the subsequent steps again.

In the present embodiment, the controller 200 determines a cooling time for each imaging condition included in the X-ray imaging information and the magnitude of the second DC voltage at the same time as the X-ray emission and controls the second booster 106 to output the second DC voltage having the determined magnitude. With this operation, the maximum charging time for the capacitor 108 can be secured, which minimizes the waiting time for X-ray generation. The waiting time occurs due to an insufficient charging voltage for the capacitor 108 after the cooling time is over.

Second Embodiment

A method of driving the X-ray generator, according to the second embodiment, is substantially the same as the method of the first embodiment in terms of operations of step ST10 to step ST40. However, the driving method of the second embodiment differs from the driving method of the first embodiment in that the controller 200 measures the real-time temperature of the X-ray source 400 with the use of the temperature sensor 250 after the completion of the X-ray emission (ST60) instead of calculating the cooling time for each imaging condition included in the X-ray imaging information when starting the X-ray emission of step ST40.

Next, the cooling time for each temperature of the X-ray source 400 is calculated on the basis of the real-time temperature of the X-ray source 400. To this end, per-temperature cooling time information that is a table in which temperatures of the X-ray source 400 and cooling times are respectively matched is stored in the memory 240.

Next, the controller 200 determines the magnitude of the second DC voltage for charging the capacitor 108 to a predetermined voltage value or more during the calculated cooling time (ST55) and adjusts the ON and OFF cycle of the switching element SW of the booster 106 such that the booster 106 outputs the second DC voltage having the magnitude determined in step ST55 (ST60).

The second embodiment is advantageous over the first embodiment in that the cooling time can be determined according to the real-time temperature of the X-ray source 400 but is disadvantageous in that the charging time for the charging the capacitor 108 is slightly reduced because the calculation of the cooling time is performed after the completion of the X-ray emission.

Therefore, preferably, the controller 200 controls the booster 106 to output a second DC voltage having a predetermined magnitude at the same time as the time at which the X-ray emission is performed, and, after step ST55, the controller 200 adjusts the second DC voltage to have a magnitude determined in step ST55.

While the present invention has been particularly illustrated and described with reference to exemplary modes, it is to be understood that the present invention is not limited to the disclosed exemplary modes and that modifications thereto are possible.

Therefore the scope of the present invention should not be limited to the preferred embodiments but should be defined by the claims and their equivalents.

EXPLANATION OF REFERENCE NUMERALS

100: Power supply unit
200: Controller
300: Power converter
400: X-ray source

What is claimed is:

1. An X-ray generator comprising:

a booster configured to boost a first DC voltage supplied from a voltage source to a second DC voltage that is higher in magnitude than the first DC voltage;

at least one capacitor configured to receive the second DC voltage and to generate a charging voltage;

a converter configured to convert the charging voltage into a driving voltage;

an X-ray source configured to receive the driving voltage and to emit X-rays; and a controller configured to control the booster, the converter, and the X-ray source, wherein the second DC voltage is variable, and the controller calculates a cooling time that is taken for the X-ray source to be cooled to below a predetermined temperature after the X-ray source emits X-rays, determines the magnitude of the second DC voltage according to the cooling time, and applies the second DC voltage to the capacitor for the cooling time.

2. The X-ray generator according to claim 1, wherein the booster comprises:

an input terminal including an inductor connected to the voltage source;

an output terminal including a diode connected to the capacitor; and a switching element configured to turn on and off such that the input terminal and the output terminal are connected to each other or disconnected from each other, and wherein the controller adjusts the second DC voltage by adjusting an ON and OFF cycle of the switching element.

3. The X-ray generator according to claim 2, wherein the booster further comprises:

an input capacitor connected in parallel between the voltage source and the inductor; and an output capacitor connected in parallel between the diode and the capacitor.

4. The X-ray generator according to claim 1, wherein the controller blocks the driving voltage not to be applied to the X-ray source for the cooling time.

5. The X-ray generator according to claim 1, further comprising: a user input unit configured to receive X-ray imaging information including an X-ray imaging mode and imaging conditions from a user, wherein the controller calculates the cooling time on the basis of the X-ray imaging information after the X-ray imaging information is input.

6. The X-ray generator according to claim 1, further comprising: a temperature sensor configured to measure a temperature of the X-ray source, wherein the controller calculates the cooling time on the basis of the temperature of the X-ray source after the X-ray source emits X-rays.

* * * * *